United States Patent [19]

Lautenschläger

[11] 4,329,759

[45] May 18, 1982

[54] OVER-CENTER HINGE, ESPECIALLY FOR MIRRORED CABINET DOORS

[75] Inventor: Reinhard Lautenschläger, Reinheim, Fed. Rep. of Germany

[73] Assignee: Karl Lautenschläger KG, Reinheim, Fed. Rep. of Germany

[21] Appl. No.: 133,247

[22] Filed: Mar. 24, 1980

[30] Foreign Application Priority Data

Mar. 30, 1979 [DE] Fed. Rep. of Germany ..... 2912813

[51] Int. Cl.[3] ..... F05D 11/10

[52] U.S. Cl. ..... 16/335; 292/73

[58] Field of Search ..... 16/139–146, 16/137, 163, 164–166, DIG. 32, 335; 292/73, 76, 77, 249; 24/255 SL

[56] References Cited

U.S. PATENT DOCUMENTS

| | | | |
|---|---|---|---|
| 2,565,636 | 8/1951 | Tinnerman | 292/76 |
| 2,805,442 | 9/1957 | Ragsdale | 16/139 X |
| 3,081,117 | 3/1963 | McDaniel | 16/DIG. 32 |
| 3,155,411 | 11/1964 | Sandor | 16/DIG. 32 |
| 3,893,209 | 7/1975 | Sewing et al. | 16/164 |
| 4,138,151 | 2/1979 | Nakao | 292/76 |
| 4,240,179 | 12/1980 | Lautenschläger | 16/139 |

FOREIGN PATENT DOCUMENTS 2516397 10/1976 Fed. Rep. of Germany .

*Primary Examiner*—Louis Rimrodt

[57] ABSTRACT

Over-center hinge for thin-walled doors of cabinets, especially of bathroom mirrored cabinets, having a shallow, door-related hinge part which is articulately joined to a supporting arm fastenable to the supporting walls of the cabinet, and which can be fastened, preferably by cementing, in a matching recess provided on the inner side of the door. A molded piece (36) is removably fastened to the door-related hinge part (12) and bears a tongue (34) which, upon the hinge's closing movement, extends into the path of an engaging surface (pivot eye 15) provided on the supporting arm (18) and can be displaced resiliently against a spring force by this engaging surface, and on which the engaging surface slips during a part of the closing movement beyond a dead-center position on one side of which the tongue (34) exerts on the supporting arm (18) a force in the hinge-opening direction and on the other side of which it exerts thereon a force acting in the hinge closing direction.

12 Claims, 8 Drawing Figures

OVER-CENTER HINGE, ESPECIALLY FOR MIRRORED CABINET DOORS

BACKGROUND

The invention relates to an over-center hinge for the thin doors of cabinets, especially of mirrored cabinets for bathrooms, which has a cabinet door-related, flat part which is to be fastened preferably by cementing in a mating recess provided on the inside of the door, and which is articulated to a supporting arm which can be fastened to the door-supporting walls of the cabinet.

Hinges of this kind are known (e.g., German Offenlegungsschrift No. 2,516,397), and they are widely used preferentially for mirrored cabinets for bathrooms. Separate ball catches or magnetic catches are needed in order to hold the mirrored doors in the closed position, because it is difficult on account of the small dimensions of the hinges, especially the extremely low profile of the door-related part, to provide an over-center mechanism, for example in the form of a resiliently displaceable tongue of the kind that has proven practical in the case of over-center hinges of the regular size having a cup-like door-related part for the mounting of wood doors (German Pat. No. 2,122,857). The small dimensions, particularly the meager depth of the door-related part, would, in the case of a mirrored cabinet hinge of the kind in question here, would inevitably result in such a reduction of the dimensions of all parts, especially the tongue of the over-center mechanism, that only extremely short closing travel could be achieved, which would necessitate the use of high spring forces for the bias of the tongue, because no appreciable leverage would be possible. Even if one should succeed in providing springs of the necessary force in the door-related part, the over-center mechanism would have to act directly and with difficulty, so that the especially desirable constant holding force, intensified within range of the closed position, would not be achieved in the above-mentioned known over-center hinges.

THE INVENTION

The invention, however, has the object of adding to hinges of the kind here in question, designed for mirrored cabinet doors, a functionally satisfactory over-center mechanism, so that the installation of separate catches will be unnecessary.

Setting out from a hinge of the kind mentioned in the beginning, this object is achieved pursuant to the invention by fastening to the door-related hinge part a molded piece which has a tongue, known in itself, which projects into the path traveled during the hinge closing movement by an engaging surface provided on the supporting arm, and can be resiliently displaced by this engaging surface, and on which the engaging surface slides during part of the closing movement through a dead center position on one side of which the tongue acts on the supporting arm to open the hinge, and on the other side of which it acts on the supporting arm to close the hinge.

In contradistinction to the known over-center hinges in which the resiliently displaceable tongue is provided within the door-related part which is in the form of a cup for mounting in a recess, in the hinge of the invention, therefore, a molded piece provided with a resilient tongue can be fastened separately to the door-related hinge part so as to project from the latter, thereby permitting the tongue to be sufficiently long.

The molded piece is preferably removably fastened on a mounting projection extending from the inside of the door from the door-related hinge part, it being recommendable to design the molded piece so as to be pushed matingly onto the mounting projection on the door-related hinge part in the direction of the deformation of the tongue, and so as to be removable therefrom in the opposite direction. The closing pressure acting between the tongue on the molded piece and the supporting arm when the hinge is closed serves simultaneously to hold the molded piece on the mounting projection. Particularly desirable is a design in which the mounting projection has a T-shaped cross section in a plane at right angles to the direction of insertion of the molded piece, and the molded piece has a complementary T-shaped recess open at least on its one side. The sliding fit thus achieved makes it possible to install the molded piece simply and rapidly, and, as is also advantageous in certain cases, to remove it again. For if it develops that, when two over-center hinges of the kind in accordance with the invention are used, the holding force is too high, it will then be easily possible to remove the molded piece from one of the hinges, so that the door is then held closed with only half of the holding force. This can be accomplished simply and rapidly without using tools for the removal of screws or the like.

For the precise alignment of the tongue relative to the engaging surface of the support arm, abutment surfaces which engage one another when the molded piece is properly installed on the mounting projection are provided on the mounting projection and in the recess in the molded piece, this being best accomplished by broadening the cross-arm of the T-shaped projection at its rearward end portion with respect to the direction of installation thrust, and the recess in the molded piece, which is associated with the cross-arm, is accordingly broadened in its forward end area with respect to the direction of installation thrust, so that the abutment surfaces are then formed by the transition surfaces between the broadened and the narrower portion of the cross-arm and recess, respectively.

To prevent the accidental withdrawal of the molded piece from the mounting projection when the door is open, catching means can be provided to secure the molded piece on the mounting projection in the proper installed position.

If the door-related hinge part is made at least in part of die-cast metal, it is desirable to cast the mounting projection integrally with the die casting, although it is also basically conceivable, of course, to make it separate and install it afterwards.

On the other hand, it is desirable to make the molded piece of injection-molded plastic and to make the resilient tongue integral therewith.

The invention will be further explained in the description that follows of an example of its embodiment in conjunction with the appended drawing, wherein.

Figure 1:
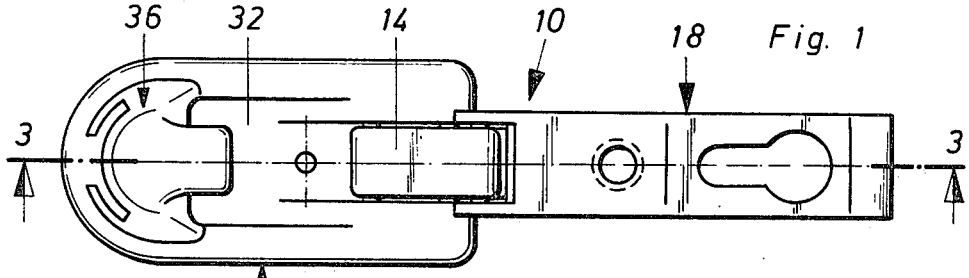
FIGS. 1 and 2 are a top view and side view, respectively, of a hinge for mirrored cabinet doors, which is provided in the manner of the invention with an over-center mechanism.
Figure 2:
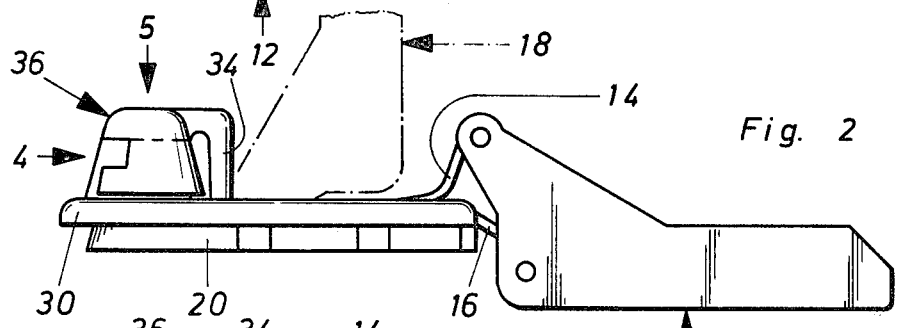
Figure 3:
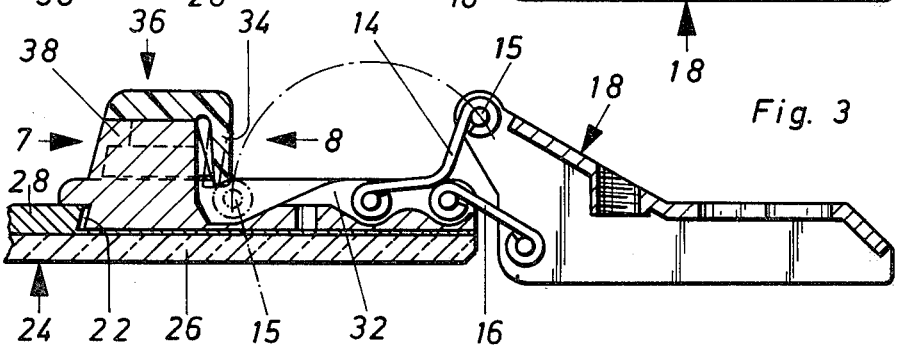
FIG. 3 is a cross-sectional view taken along line 3—3 in FIG. 1.
Figure 4:
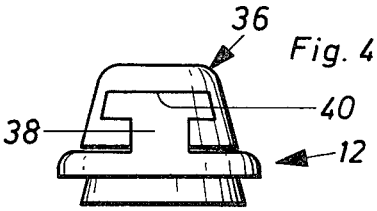
FIG. 4 is an elevational view of the hinge shown in FIGS. 1 to 3 as seen in the direction of arrow 4 in FIG. 2.

The hinge of the invention, identified as a whole by the number 10 in FIGS. 1 to 3, has a door-related part 12 which is joined by two links 14 and 16 pivotingly attached thereto to a supporting arm 18 wherein links 14 and 16 are also pivotingly attached. The supporting arm 18 can be fastened adjustably, in a known manner, on a mounting plate, not shown, which is disposed on the supporting wall of the cabinet.

The door-related hinge part 12, which is elongated in plan and rounded at its outermost end, as best seen in FIGS. 2 and 3, is of very shallow construction and has a base portion 20 amounting to half its thickness, which is to be fitted and fastened, by cementing, for example, into a mating recess 22 in a thin door leaf 24, such as the door of a mirrored cabinet (FIG. 3). The door leaf 24 is composed in this instance of an external plate 26 consisting of mirror glass and an internal mounting plate 28 to which the mirror is cemented, and which, if desired, can also be a sheet of mirror glass backed against the external plate 26. In any case, the recess 22 designed for the attachment of the base portion 20 of the door-related hinge part 12 is formed in this internal mounting plate. Above the base portion 20, the door-related hinge plate 12 is broadened to form a flange 30. This flange, which conceals the seam between the base portion 20 and the edge of the recess, is provided all around the base section 20 with the exception of its edge facing the supporting arm 18. This edge is approximately flush with the door edge, so that the recess 22, therefore, is open at its supporting-arm end.

In the door-related hinge member 12 there is formed an elongated recess 32 which is open on the side facing the viewer of FIG. 1, and the ends of links 14 and 16, which are rolled to form pivot eyes, are mounted on pins set in the supporting-arm end of recess 32. The area of recess 32 remote from the supporting arm 18 serves to accommodate a projecting portion of the supporting arm when the hinge is closed. The position of the supporting arm 18 when the hinge is closed is additionally represented in FIG. 2 by the broken outline of the front end of the supporting arm, and it can be seen that, in this position, the projecting section of the supporting arm, and hence the pivot pin 15 of link 14, is situated within the recess 32. The position of this pivot pin and the eye of the link is also represented in broken lines in FIG. 3.

Figure 5:
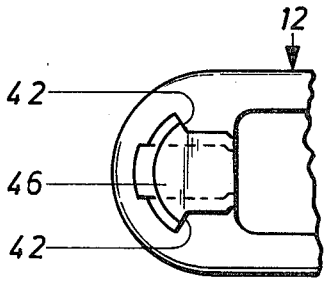
FIG. 5 is a partial top view of the door-related hinge part of the invention, as seen in the direction of arrow 5 in FIG. 2, but without the molded piece forming part of the over-center mechanism.
Figure 7:
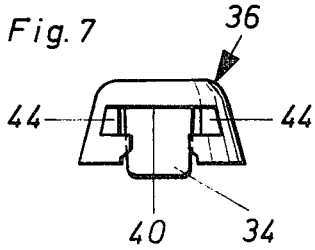
FIG. 7 is a view of the molded piece as seen in the direction represented by the arrow 7 in FIG. 3.
Figure 8:
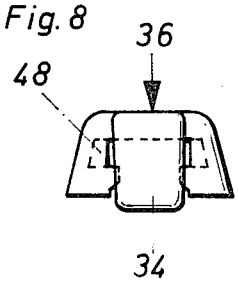
FIG. 8 is a view of the molded piece as seen in the direction of arrow 8 of FIG. 3.
Figure 6:
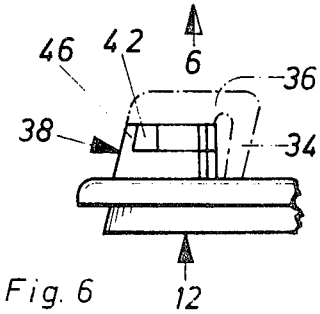
FIG. 6 is an elevational view as seen in the direction of arrow 6 in FIG. 5.

The over-center mechanism of hinge 10 is formed by a resiliently deformable tongue 34 cooperating with the pivot eye 15 on the supporting-arm end of link 14. This tongue 34 is integrally injection molded with molded part 36 from plastic having the required resilient properties, being situated on the upper, free end of molded piece 36 and being inclined in the manner best seen in FIG. 3, so that its free front end terminates within the recess 32. The molded piece 36, which is rounded in its rearward portion to match the rounding of the door-related hinge part 12, is fastened on a holding projection 38 of T-shaped cross section projecting from the door-related hinge part 12, the holding projection being in the present case (FIGS. 5 and 6) diecast from metal integrally with the door-related hinge part 12. The molded piece 36 (FIGS. 7 and 8) has in turn a matching T-shaped recess 40 at its bottom facing the door-related hinge part 12 and at its side opposite the tongue 34, so that its installation and removal from the door-related hinge part can be accomplished very easily and quickly by pushing it onto or pulling it off from the holding projection 38 longitudinally of the hinge. The molded piece 36 is fixed in proper assembled position by the abutments 42 and 44 which are formed by the transition surfaces between a broadened portion 46 of the cross-member of the T-shaped holding projection 38 and by corresponding transition surfaces in an associated broadening 48 of the recess 40.

The operation of the over-center device of the invention is now clear. When the door 24 is swung from the open position shown in FIGS. 1 to 3 to the closed position, the pivot eye 15 of link 14 on the end of the supporting arm moves along the arc represented in broken lines in FIG. 3 to the end position also represented in broken lines. Before reaching this end portion, the pivot eye 15 engages the outer side of the tongue 34 and flexes it resiliently rearward, i.e., toward the holding projection 38. At the same time the tongue 34 initially seeks to force the eye 15 and hence the supporting arm 14 back to the open position, until a dead center is reached beyond which a force acts in the closing direction on the eye. Since the inclination of the tongue is made such that, even in the closed position, it is still deflected from its undeformed state, the door leaf 24 is held with sufficient force in its closed position.

I claim:

1. An over-center hinge for a thin-walled door of a cabinet, especially of a bathroom mirrored cabinet, said hinge being movable in a closing direction and opening direction and vice versa, and having a relatively shallow, door-related hinge part which is articulately joined to a supporting arm fastenable to a supporting wall of the cabinet, and which is fastenable in a matching recess on the side of the door facing the inside of the cabinet, said door-related hinge part having a holding projection having a T-shaped cross-section and projecting beyond said shallow hinge part, a molded piece removably fastened to said holding projection of said door-related hinge part, said molded piece having a T-shaped recess complementary to said cross-section, which recess opens at least on one side of said molded piece and at its bottom to permit removable mounting on said holding projection, said molded piece having a tongue with a tip extending into said hinge part and which, during the hinge's movement in closing direction, extends into the path of an engaging surface provided on said supporting arm and is displaceable resiliently against a spring force by said engaging surface, and on which tongue said engaging surface slips during a part of the closing movement beyond a dead-center position on one side of which position said tongue exerts on said supporting arm a force in said opening direction and on the other side of which it exerts thereon a force acting in said closing direction.

2. An over-center hinge according to claim 1, wherein said engaging surface is part of a pivot eye.

3. An over-center hinge according to claim 1, wherein said molded piece is constructed so as to be adapted to be pushed matingly onto said holding projection of the door-related hinge part in the direction of the deformation of the tongue, and so constructed as to be removable therefrom in a direction opposite to said last-mentioned direction.

4. An over-center hinge according to claim 3 comprising abutment surfaces on the holding projection and in the recess in the molded piece, which abutment surfaces engage one another when the molded piece is in fastened position on the holding projection.

5. An over-center hinge according to claim 1 comprising abutment surfaces on the holding projection and in the recess in the molded piece, which abutment surfaces engage one another when the molded piece is in fastened position on the holding projection.

6. An over-center hinge according to any one of claims 1, 3, 4 or 5, wherein said T-shaped holding projection has a cross-arm having a broadened portion at its rearward end portion in the mounting direction, and wherein the recess has a correspondingly broadened portion at a beginning portion associated with said cross-arm, said abutment surfaces being formed by transition surfaces between said broadened portions and adjacent narrower portions of the cross-arm and of the recess, respectively.

7. An over-center hinge according to claim 6, comprising catch means securing said molded piece in said fastened position against unintentional withdrawal from the holding projection.

8. An over-center hinge according to claim 7, wherein said door-related hinge part is formed at least in part as a die-cast metal piece, and wherein said holding projection is integrally cast on said die-cast metal piece.

9. An over-center hinge according to claim 7, wherein said molded piece is an injection-molded plastic piece and the resilient tongue is integrally injection-molded on the molded piece.

10. An over-center hinge according to any one of claims 1, 3, 4 or 5, wherein said door-related hinge part is formed at least in part as a die-cast metal piece, and wherein said holding projection is integrally cast on said die-cast metal piece.

11. An over-center hinge according to claim 10, wherein said molded piece is an injection-molded plastic piece and the resilient tongue is integrally injection-molded on the molded piece.

12. An over-center hinge according to any one of claims 1, 3, 4 or 5, wherein said molded piece is an injection-molded plastic piece and the resilient tongue is integrally injection-molded on the molded piece.

* * * * *